US008744112B2

(12) United States Patent
Kim

(10) Patent No.: US 8,744,112 B2
(45) Date of Patent: Jun. 3, 2014

(54) EARPHONE WITH SPEAKER FACING AWAY FROM EARPIECE AND SOUND TUBE THAT COMMUNICATES WITH SPACES IN FRONT OF AND BEHIND THE SPEAKER

(75) Inventor: Heung Bae Kim, Bucheon-si (KR)

(73) Assignee: S-Link Limited, Hong Kong (CN)

( * ) Notice: Subject to any disclaimer, the term of this patent is extended or adjusted under 35 U.S.C. 154(b) by 10 days.

(21) Appl. No.: 13/564,455

(22) Filed: Aug. 1, 2012

(65) Prior Publication Data

US 2013/0336512 A1 Dec. 19, 2013

(30) Foreign Application Priority Data

Jun. 19, 2012 (KR) ..... 10-2012-0065532

(51) Int. Cl.
*H04R 25/00* (2006.01)

(52) U.S. Cl.
USPC ..... 381/380; 381/328

(58) Field of Classification Search
USPC ..... 381/322, 328, 370–384
See application file for complete search history.

(56) References Cited

U.S. PATENT DOCUMENTS

2009/0028348 A1* 1/2009 Sokolich et al. ..... 381/59
2010/0310106 A1* 12/2010 Blanchard et al. ..... 381/351

* cited by examiner

*Primary Examiner* — Brian Ensey
*Assistant Examiner* — Katherine Faley
(74) *Attorney, Agent, or Firm* — Fenwick & West LLP

(57) ABSTRACT

Provided is an earphone capable of protecting a user's tympanic membrane, improving the durability thereof, and enjoying the further improved quality of sound by adjusting a medium-low pitched sound. In the earphone, a micro speaker mounted on a partition wall dividing an inner space is embedded in a housing. An earpiece is connected to the housing and is inserted into an external auditory canal, and a sound band adjustment unit is provided in the housing.

5 Claims, 1 Drawing Sheet

EARPHONE WITH SPEAKER FACING AWAY FROM EARPIECE AND SOUND TUBE THAT COMMUNICATES WITH SPACES IN FRONT OF AND BEHIND THE SPEAKER

CROSS-REFERENCE TO RELATED APPLICATION

This application claims priority of Korean Patent Application No. 10-2012-0065532, filed on Jun. 19, 2012, in the Korean Intellectual Property Office, which is hereby incorporated by reference in its entirety.

BACKGROUND OF THE INVENTION

1. Field of the Invention

The present invention relates to an earphone, and more particularly, to an earphone which is capable of protecting a user's tympanic membrane, improving the durability thereof, and enjoying the further improved quality of sound by adjusting a medium-low pitched sound.

2. Description of the Related Art

Most recent portable terminals are designed such that users can use the functions of an MP3 player and a PMP, as well as the call function, and can enjoy various media contents combined with audios and videos. For enjoying ample volumes of such portable terminals, an earphone is an essential item.

In general, an earphone is mounted with an elastic earpiece on an outer surface of a housing. A diaphragm is disposed in a speaker toward a side where the earpiece is mounted, and the speaker is embedded in the housing. When the above-described earpiece comes into close contact with a user's external auditory canal, the earphone transmits a sound to the user.

However, if the general earphone having such a structure is used in close contact with the user's external auditory canal for a long period of time, the user may feel pain and uncomfortable at his or her external auditory canal, and the user's tympanic membrane may be badly affected.

Therefore, from the above-described point of view, there have been proposed technologies that maintain a pressure balance between an inner space of a housing and an inner space of an external auditory canal closely contacting an earpiece by forming a small hole communicating with the inner space in an outer surface of the housing close to the earpiece, thereby reducing pain the user may feel.

However, due to the structure of the housing through which the small hole penetrates, the earphone having the above-described structure causes loss of a medium-low band and causes a considerable change over an entire frequency band of a sound. As a result, problems such as a tone distortion arise.

SUMMARY OF THE INVENTION

The present invention is directed to provide an earphone which is capable of protecting a user's tympanic membrane, improving the durability thereof, and enjoying the further improved quality of sound by adjusting a medium-low pitched sound.

According to an embodiment of the present invention, an earphone includes: a housing in which a sound transmission tube to be inserted into an external auditory canal protrudes from one side thereof and which forms an inner space; an earpiece connected to an outer circumferential surface of the sound transmission tube and coming into close contact with the external auditory canal; a partition wall embedded in the housing and dividing the inner space into a first resonance space at a side where the sound transmission tube is formed, and a second resonance space at a side opposite to the sound transmission tube; a micro speaker mounted on the partition wall and including a diaphragm disposed toward the second resonance space; and a sound band adjustment unit disposed in the sound transmission tube and the first resonance space, communicating with the second resonance space, and adjusting a sound band generated from the micro speaker.

The sound band adjustment unit may include a sound tube having both ends opened, the sound tube being disposed in the sound transmission tube and the first resonance space, an end of the sound tube being fixed to the partition wall such that the sound tube communicates with the second resonance space.

The earphone may further include a communication hole penetrating an outer wall of the housing in the second resonance space.

When a diameter of the sound tube increases, the sound band adjustment unit may allow a sound of a low frequency band to pass, and when a length of the sound tube increases, the sound band adjustment unit may allow a sound of a high frequency band to pass.

The sound band adjustment unit may further include an adjustment mechanism that is formed on the partition wall in correspondence to a diameter of the sound tube and comes into close contact with an outer circumferential surface of the sound tube.

The adjustment mechanism may include: a center hole having a diameter smaller than the sound tube and penetrating the partition wall; a plurality of slits formed radially from an edge of the center hole; and an adjustment piece formed by an area between the adjacent slits from the edge of the center hole and allowing a shape modification in one direction, the adjustment piece contacting and adhering to an outer circumferential surface of the sound tube.

DETAILED DESCRIPTION OF EXEMPLARY EMBODIMENTS

Hereinafter, preferred embodiments of the present invention will be described with reference to the accompanying drawings.

Figure 1:
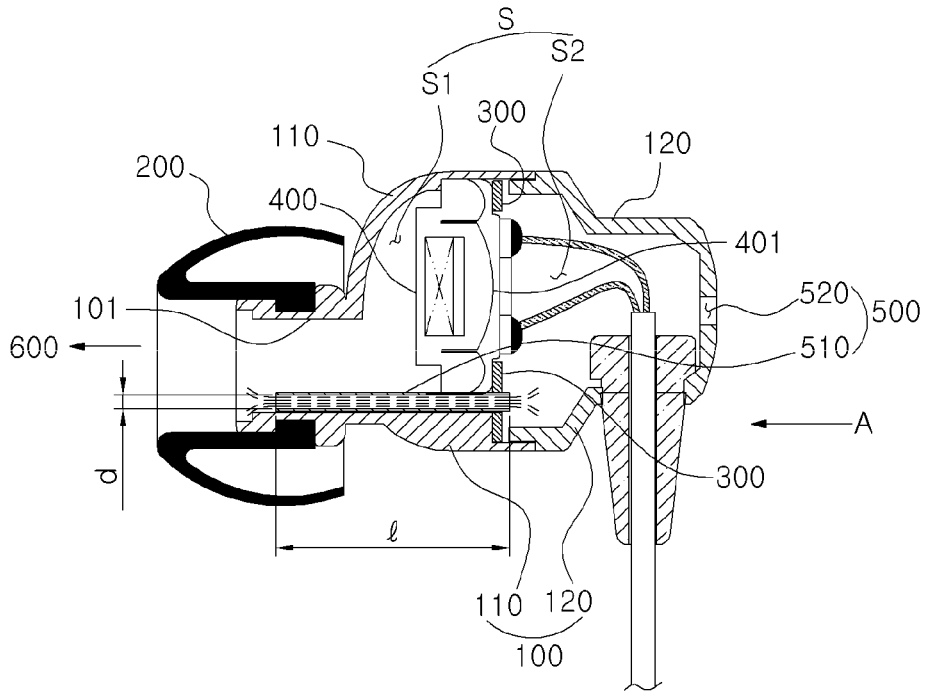
FIG. 1 is a cross-sectional conceptual diagram illustrating an entire configuration of an earphone according to an embodiment of the present invention.

FIG. 1 is a cross-sectional conceptual diagram illustrating an entire configuration of an earphone according to an embodiment of the present invention. Reference numeral 600 denotes a direction of a user's external auditory canal side. In the following description, even though the user's external auditory canal 600 is not specifically illustrated, reference numeral 600 will be collectively used to denote a position and direction where the external auditory canal 600 exists.

In addition, a plurality of straight lines and curves indicated by dotted lines within a sound tube 510 constituting a sound band adjustment unit 500, which is to be described later, denote sound transmission paths.

As illustrated, a micro speaker 400 mounted on a partition wall 300 dividing an inner space S into two sub-spaces is embedded in a housing 100. An earpiece 200 is connected to the housing and is inserted into an external auditory canal 600. The sound band adjustment unit 500 is provided in the housing 100.

A sound transmission tube 101 to be inserted into the external auditory canal 600 protrudes from one side of the housing 100, and the housing 100 forms the inner space S where components to be described later are mounted.

The earpiece 200 is connected to an external circumferential surface of the sound transmission tube 101 and comes into close contact with the external auditory canal 600. The earpiece 200 serves to prevent the housing 100 from falling out of the external auditory canal 600.

The partition wall 300 is embedded in the housing 100 and divides the inner space S into a first resonance space S1 at a side where the sound transmission tube 101 is formed, and a second resonance space S2 at a side opposite to the sound transmission tube 101. The partition wall 300 provides mount areas for the micro speaker 400 and the sound band adjustment unit 500.

The micro speaker 400 is mounted on the partition wall 300 and includes a diaphragm 401 disposed toward the second resonance space S2. The micro speaker 400 outputs sounds from various sound source media including music and an audio.

The sound band adjustment unit 500 is disposed in the sound transmission tube 101 and the first resonance space S1. The sound band adjustment unit 500 communicates with the second resonance space S2, adjusts a sound of a medium-low band generated from the micro speaker 400, and transmits the adjusted sound through the external auditory canal 600.

According to the present invention, the above-described embodiment can be applied, and the following various embodiments can also be applied.

As described above, the housing 100 provides the space for mounting the respective components according to the present invention, including the earpiece 200. For convenience of assembly and connection, the housing 100 may be divided into a first case 110, in which the sound transmission tube 101 is formed to define the first resonance space S1, and a second case 120, in which the second resonance space S2 is defined.

The first case 110 and the second case 120 may be connected together in various coupling methods. The partition wall 300 may be disposed at the connection portion of the first and second cases 110 and 120.

The partition wall 300 may be fixed along an inner edge of the first case 110 by an adhesive or the like. Although not specifically illustrated, various coupling structures can also be applied. For example, a latching protrusion may be formed along the inner edge of the first case 110, and the edge of the partition wall 300 may be press-fit to the latching protrusion.

Meanwhile, as described above, the micro speaker 400 outputs sounds from various sound source media, including music and an audio. Since the diaphragm 401 is disposed in a direction farther away from the external auditory canal 600, that is, the opposite side of the sound transmission tube 101, the sound output is not directly transmitted to the user's tympanic membrane. Therefore, this is good for the user's health.

The micro speaker 400 is a speaker capable of increasing a bandwidth to a high frequency region by improving a structure such that a vibrating sound caused by the diaphragm and a vibrating sound caused by a coil can be transmitted to the user's tympanic membrane. The detailed structure and operational relationship are disclosed in Korean Patent Application No. 10-2009-0057556, filed by the applicant of this patent application on Jun. 26, 2009, and the relevant Korean Patent Registration No. 10-1045613, entitled "MICRO SPEAKER", which is hereby incorporated by reference in its entirety.

Meanwhile, as described above, the sound band adjustment unit 500 emphasizes a frequency band of a medium-low sound for providing a rich tone, and transmits it through the user's external auditory canal 600. The sound band adjustment unit 500 includes a sound tube 510.

In addition to the above-described function, the sound band adjustment unit 500 serves as a technical component that can prevent problems, such as a slight pain felt by the user, by tightly sealing the user's tympanic membrane and the first resonance space S1 in the process of transmitting the sound to the user's tympanic membrane while the earpiece 200 comes into close contact with the external auditory canal 600.

The sound tube 510 is a member having both ends opened, Specifically, the sound tube 510 is disposed in the sound transmission tube 101 and the first resonance space S1, and an end of the sound tube 510 is fixed to the partition wall 300 such that the sound tube 510 communicates with the second resonance space S2.

In addition, the sound band adjustment unit 500 may further include a communication hole 520 penetrating the outer wall of the housing 100 of the second resonance space S2 side.

Therefore, even when the user listens to the sound output from the micro speaker 400 while closely contacting the earpiece 200 with his or her external auditory canal 600, the pressure balance is maintained by mutually communicating the spaces from the tympanic membrane to the first and second resonance spaces S1 and S2 through the external auditory canal 600. Therefore, it is possible to relieve pain caused through the inner space of the user's external auditory canal 600 according to the formation of the sealed space.

If the diameter d of the sound tube 510 increases, a sound of a low frequency band is allowed to pass, thereby obtaining the effect of offsetting a low pitched sound.

If the length l of the sound tube 510 increases, a sound of a high frequency band is allowed to pass, thereby obtaining the effect of offsetting a high pitched sound.

On the contrary, if the diameter d of the sound tube 510 decreases, a sound of a high frequency band is allowed to pass, thereby obtaining the effect of offsetting a high pitched sound.

In addition, if the length l of the sound tube 510 decreases, a sound of a low frequency band is allowed to pass, thereby obtaining the effect of offsetting a low pitched sound.

Therefore, the user can enjoy sounds of various tones according to the use of the sound tube 510, the diameter d and the length l of which are appropriately adjusted.

Meanwhile, the sound band adjustment unit 500 may further include an adjustment mechanism 550 that is formed on the partition wall 300 and closely contacts the outer circumferential surface of the sound tube 510. The adjustment mechanism 550 is formed in correspondence to the various diameters d of the sound tube 510 so as to enjoy sounds of various tones.

Figure 2:
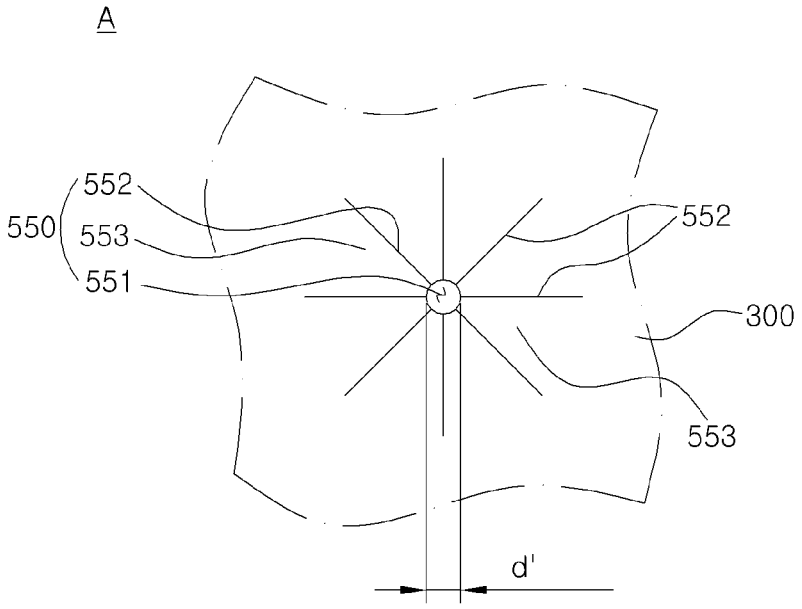
FIG. 2 is a conceptual diagram illustrating a shape of an adjustment mechanism included in a sound band adjustment unit that is a main part of the earphone according to the embodiment of the present invention.

Specifically, referring to FIG. 2, the adjustment mechanism 550 includes an adjustment piece 553 formed with slits 552 along an edge of a center hole 551.

The center hole 551 has a diameter smaller than the sound tube 510 and penetrates the partition wall 300. The slit 552 is formed at a plurality of positions radially from the edge of the center hole 551.

The adjustment piece 553 is formed by an area between the adjacent slits 552 from the edge of the center hole 551, and allows a shape modification in one direction.

Therefore, the adjustment piece 553 may fix the sound tube 510 by contacting and adhering to the outer circumferential surface of the sound tube 510 or by maintaining the close contact state.

As described above, the basic technical spirit of the present invention is to provide an earphone which is capable of protecting a user's tympanic membrane, improving the durability thereof, and enjoying further improved sound by adjusting a medium-low pitched sound.

The present invention can obtain the following effects.

A user's external auditory canal can be protected by arranging a diaphragm of a micro speaker in a direction opposite to a sound transmission tube.

In addition, a micro speaker is mounted on a partition wall dividing a housing into first and second resonance spaces, and a sound band adjustment unit is disposed in a sound transmission tube and the first resonance space, and communicates with the outside of the housing through the second resonance space. Therefore, the durability of the earphone can be improved, and the rich tone can be provided by adjusting a medium-low pitched sound.

It is apparent that various modifications and applications can also be made by those skilled in the art, without departing from the basic technical spirit and scope of the present invention.

What is claimed is:

1. An earphone comprising:

a housing in which a sound transmission tube to be inserted into an external auditory canal protrudes from one side thereof and which forms an inner space;

an earpiece connected to an outer circumferential surface of the sound transmission tube and coming into close contact with the external auditory canal;

a partition wall embedded in the housing and dividing the inner space into a first resonance space at a side where the sound transmission tube is formed, and a second resonance space at a side opposite to the sound transmission tube;

a micro speaker mounted on the partition wall and including a diaphragm disposed toward the second resonance space; and a sound band adjustment unit disposed in the sound transmission tube and the first resonance space, communicating with the second resonance space, and adjusting a sound band generated from the micro speaker.

2. The earphone according to claim 1, wherein the sound band adjustment unit includes a sound tube having both ends opened, the sound tube being disposed in the sound transmission tube and the first resonance space, an end of the sound tube being fixed to the partition wall such that the sound tube communicates with the second resonance space.

3. The earphone according to claim 2, wherein the earphone further includes a communication hole penetrating an outer wall of the housing in the second resonance space.

4. The earphone according to claim 2, wherein the sound band adjustment unit further includes an adjustment mechanism that is formed on the partition wall in correspondence to a diameter of the sound tube and comes into close contact with an outer circumferential surface of the sound tube.

5. The earphone according to claim 4, wherein the adjustment mechanism includes:

a center hole having a diameter smaller than the sound tube and penetrating the partition wall;

a plurality of slits formed radially from an edge of the center hole; and an adjustment piece formed by an area between the adjacent slits from the edge of the center hole and allowing a shape modification in one direction, the adjustment piece contacting and adhering to an outer circumferential surface of the sound tube.

* * * * *